United States Patent [19]

Yamashita

[11] 4,038,862

[45] Aug. 2, 1977

[54] DEVICE FOR ADJUSTING THE LATERAL DISTANCE BETWEEN A PAIR OF PARALLEL TRANSFER BARS OF A TRANSFER FEEDER FOR A TRANSFER PRESS

[75] Inventor: Hisateru Yamashita, Komatsu, Japan

[73] Assignee: Kabushiki Kaisha Komatsu Seisakusho, Tokyo, Japan

[21] Appl. No.: 585,670

[22] Filed: June 10, 1975

[51] Int. Cl.[2] ..... B21D 43/10

[52] U.S. Cl. ..... 72/421

[58] Field of Search ..... 72/405, 421, 22, 420

[56] References Cited

U.S. PATENT DOCUMENTS

| | | | |
|---|---|---|---|
| 3,025,731 | 3/1962 | Jacobs | 72/421 |
| 3,105,399 | 10/1963 | Strugala | 72/405 |
| 3,324,703 | 6/1967 | Foster | 72/421 |
| 3,434,328 | 3/1969 | Taniguchi | 72/421 |
| 3,541,834 | 11/1970 | Wallis | 72/421 |
| 3,805,582 | 4/1974 | Logan | 72/405 |

*Primary Examiner*—C.W. Lanham
*Assistant Examiner*—Gene P. Crosby
*Attorney, Agent, or Firm*—Armstrong, Nikaido & Marmelstein

[57] ABSTRACT

The device for adjusting the lateral distance between a pair of parallel transfer bars of a transfer feeder for a transfer press comprises clutch means arranged in the driving means for driving toward and away a pair of slides slidably mounting thereon the transfer bars, respectively, so as to transfer work pieces to the succeeding working positions and separate driving means for driving the slides independently of the first mentioned driving means when the latter is disabled by the clutch means, so that the lateral distance is adjusted by driving the slides by the separate driving means while the first mentioned driving means is disabled. After disabling the separate driving means and the clutch means is engaged, the press is ready for operation with the newly adjusted lateral distance set between the slides and, hence, between the transfer bars. A set of limit switches are provided which cooperate with the driven member of the clutch means and operably connected to switching means of the clutch means and a clutch for the separate driving means so that the lateral distance between the slides can be automatically set by the actuation of the selected one of the limit switches which, when actuated by the driven member of the clutch means, actuates the switching means so as to engage the first mentioned clutch means while the clutch for the separate driving means is disabled after the clutch means has been disengaged and the slides have been driven by the separate driving means through the clutch.

7 Claims, 5 Drawing Figures

DEVICE FOR ADJUSTING THE LATERAL DISTANCE BETWEEN A PAIR OF PARALLEL TRANSFER BARS OF A TRANSFER FEEDER FOR A TRANSFER PRESS

BACKGROUND OF THE INVENTION

The present invention relates to a device for adjusting the lateral distance between a pair of parallel transfer bars of a transfer feeder for a transfer press.

Heretofore, the adjustment of the lateral distance between the transfer bars of the transfer feeder for use with a transfer press in order to match the distance depending upon the size of work pieces to be worked by the press have been carried out manually by moving stepwise the slides upon which the transfer bars are slidably mounted, respectively, toward or away from each other and fixedly securing the slides in the adjusted positions by securing means such as bolts, thereby rendering the operation to be very time consuming and deteriorating the efficiency of the operation.

The present invention is proposed to avoid the disadvantages of the prior art as described above.

SUMMARY OF THE INVENTION

An object of the present invention is to provide a novel and useful device for adjusting the lateral distance between a pair of parallel transfer bars of a transfer feeder for use with a transfer press which avoids the above described disadvantages of the prior art.

Another object is to provide a novel and useful device for adjusting the lateral distance between the transfer bars of a transfer feeder of the type described above having clutch means in the driving means of the slides slidably mounting thereon the transfer bars, respectively, and a separate driving means for driving the slides independently of the first mentioned driving means while the clutch means is held disengaged, thereby permitting the distance between the slides and, hence, the transfer bars to be changed depending upon the size of work pieces to be worked by the press by the separate driving means by virtue of the provision of the clutch means.

A further object is to provide a novel and useful device of the type described above having the clutch means in the driving means for the slides and the separate driving means which is provided with a plurality of switch means arranged at predetermined locations for cooperating with the driven member of the clutch means so that the adjustment of the lateral distance of the transfer bars can be automatically carried out by the selected switch means which, upon being actuated by the driven member of the clutch means, renders the clutch provided for the separate driving means to be disabled so as to stop the driving of the slides while the clutch means in the first mentioned driving means is engaged by the actuation of the selected switch means so as to be ready for the next operation of the press after the clutch means in the first mentioned driving means has been disengaged and the separate driving means has been coupled with the slides for adjusting the distance therebetween.

DETAILED DESCRIPTION OF THE PREFERRED EMBODIMENT

Figure 1:
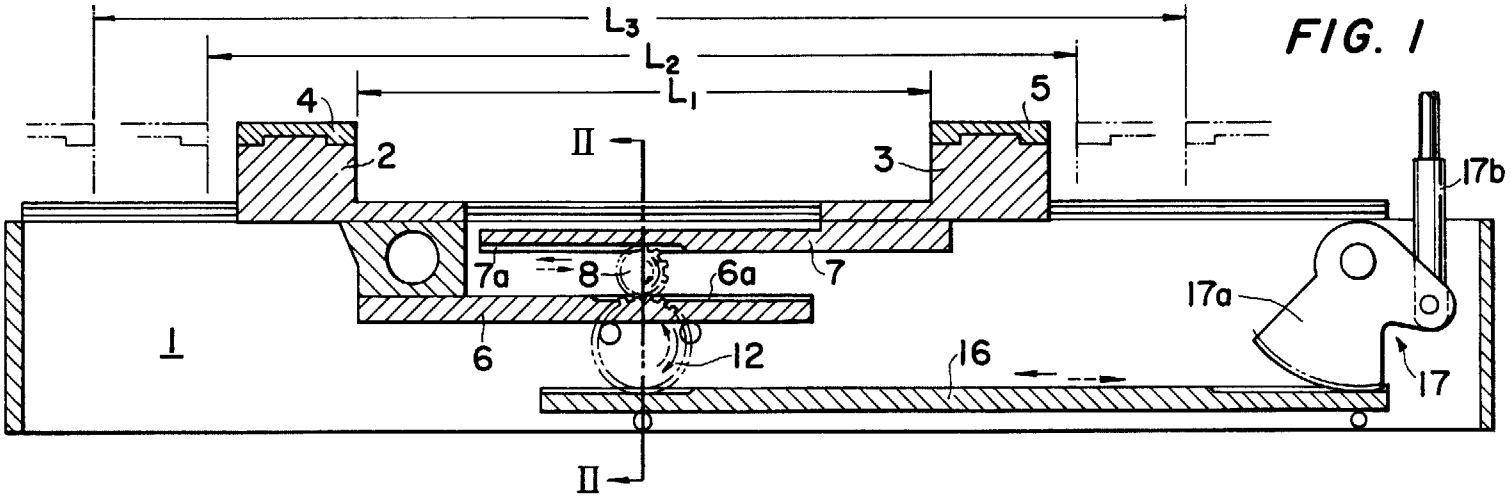
FIG. 1 is a longitudinal sectional view showing an embodiment of the device of the present invention.

Referring to FIG. 1, the main body 1 of the transfer feeder is arranged between the adjacent two transfer presses (not shown) and it slidably mounts thereon a pair of slides 2, 3 which are guided so that they are adapted to be moved toward and away from each other in the direction in the plane of the drawing. A pair of transfer bars 4, 5 are slidably mounted on the upper portions of the slides 2, 3, respectively, so as to be reciprocally guided in unison in the direction perpendicular to the plane of the drawing so that the work pieces (not shown) are successively fed to the succeeding working positions by clampers (not shown) provided in the respective transfer bars 4, 5 when they are reciprocally moved in synchronism with the movement of the slides 2, 3 toward and away from each other in the well known manner and, hence, not described in detail here.

In order to move the slides 2, 3 toward and away from each other, a pair of slider racks 6, 7 are secured to the lower portions of the slides 2, 3, respectively, in opposing relationship in parallel to each other as shown.

Figure 2:
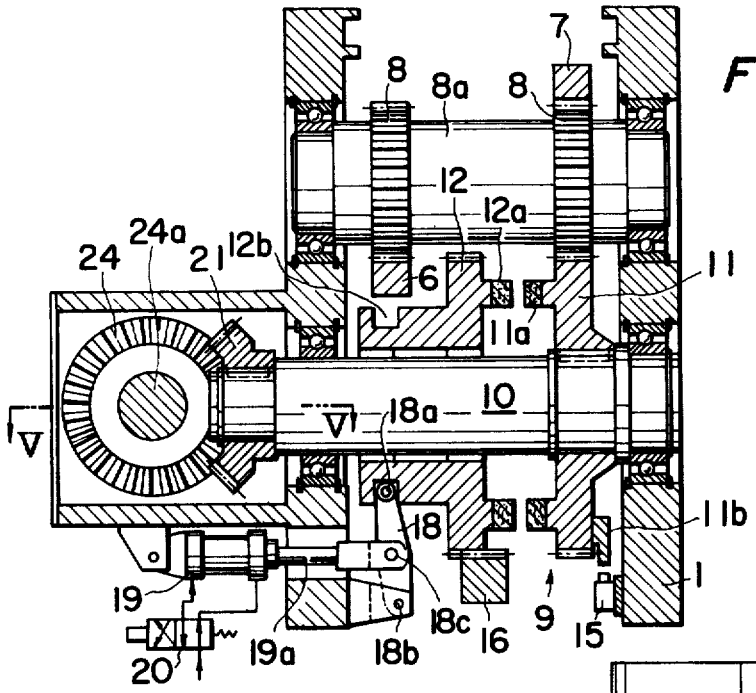
FIG. 2 is a cross-sectional view taken along line II—II in FIG. 1.

As shown in FIG. 2, a shaft **8*a* is journaled in the main body 1 by roller bearings and a pair of pinions 8, 8 are secured to the shaft 8*a*. One of the pinions 8 meshes with the toothed portion 6*a* of the rack 6 while the other pinion 8 meshes with the toothed portion 7*a* of the rack 7**.

The pinion 8 meshing with the rack 7 also meshes with a driven gear 11 which is fixedly secured by a key to a rotary shaft 10 journaled in the main body 1 as shown in FIG. 2.

A driving gear 12 is axially slidably mounted on the shaft in opposing relationship to the driven gear 11. The gear 12 is prevented its rotation relative to the shaft 10 by means such as keys so that the gear 12 is rotated together with the shaft 10.

Figure 3:
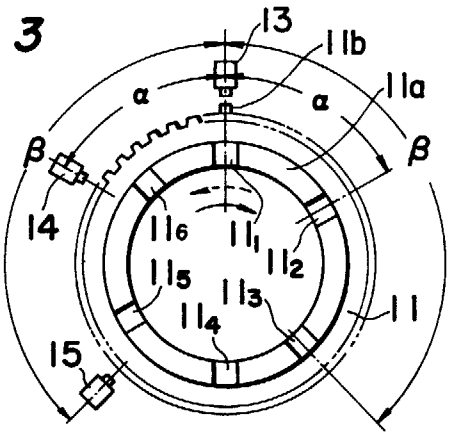
FIG. 3 is a front view showing the driven gear in the driving means of the present invention.
Figure 4:
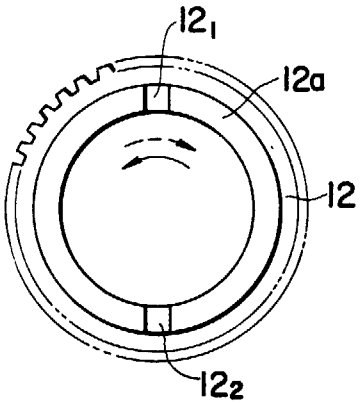
FIG. 4 is a front view showing the driving gear in the driving means of the present invention.

As shown in FIGS. 3 and 4, a clutch jaw **11*a* having a plurality of engaging recesses, for example, six recesses $\mathbf{11}_1$, $\mathbf{11}_2$, - - - $\mathbf{11}_6$ is formed in the gear 11 while a clutch jaw 12*a* having a plurality of engaging projections, for example, two projections $\mathbf{12}_1$, $\mathbf{12}_2$ is formed in the gear 12 in opposing relationship to the clutch jaw 11*a*, the clutch jaws 11*a*, 12*a* constituting clutch means 9** characterizing the present invention as described later.

As shown in FIG. 3, the engaging recess $\mathbf{11}_2$ is angularly spaced by an angle $\alpha$ from the recess $\mathbf{11}_1$, while the recess $\mathbf{11}_3$ is angularly spaced by an angle $\beta$ from the recess $\mathbf{11}_1$, and recess $\mathbf{11}_4$ to $\mathbf{11}_6$ are located diametrically opposed to the recess $\mathbf{11}_1$, $\mathbf{11}_2$ and $\mathbf{11}_3$, respectively.

As shown in FIG. 4, the engaging projections $\mathbf{12}_1$, $\mathbf{12}_2$ are located diametrically opposed to each other. Therefore, when the driving gear 12 is shifted toward the driven gear 11, the clutch jaws **11*a* and 12*a* can be engaged with each other at one of three angular positions, i.e., a first position shown in FIGS. 3 and 4, a second position angularly shifted by the angle $\alpha$ from the first position and a third position angularly shifted by the angle $\beta$ from the first position as is clearly understood by investigating FIGS. 3 and 4**.

In order to engage and disengage the clutch means 9, the driving gear 12 is formed with an annular groove 12b and a roller 18a rotatably mounted on one end of a lever 18 slidably fits in the groove 12b. The other end of the lever 18 is pivoted by a pin 18b to a fixed portion of the main body 1 while the intermediate portion of the lever 18 is pivoted by a pin 18c to the forward end of a piston rod 19a connected to a piston slidably located in a hydraulic cylinder 19 which is pivotally secured at its bottom end to the main body 1. Therefore, when the hydraulic cylinder 19 is actuated, the driving gear 12 is axially shifted through the lever 18 so that the clutch means 9 is engaged or disengaged, the actuation of the hydraulic cylinder 19 being effected by means of an electromagnetic valve 20 connected thereto as described later.

In order to effect work piece transferring operation, the clutch means 9 is engaged and a rack 16 (FIGS. 1 and 2) engaging with the driving gear 12 is reciprocally driven by a driving system 17 consisting of a pivoted sector gear 17a meshing with the rack 16 and a driving rod 17b connected to the sector gear 17a and reciprocally driven by the press in synchronism with the operation of the press.

Thus, the driven gear 11 engaged with the driving gear 12 is reciprocally driven and the pinion 8 meshing with the gear 11 is also driven reciprocally together with the shaft 8a in synchronism with the operation of the press thereby permitting the racks 6, 7 to be driven reciprocally in opposite directions to each other through the pinions 8, 8 so that the work pieces are transferred by the movement of the slides 2, 3 mounting the racks 6, 7, respectively, in combination with the movement of the transfer bars 4, 5.

In accordance with the characteristic feature of the present invention, a cam 11b is provided in the driven gear 11 as shown in FIG. 3 and a limit switch 13 is located adjacent to the gear 11 so as to be actuated by the cam 11b when the gear 11 rotates. In the similar way, limit switches 14, 15 are located adjacent to the gear 11 angularly spaced from the limit switch 13 by the angle $\alpha$ and the angle $\beta$, respectively, in opposite direction to the arrangement of the recesses $11_2$, $11_3$ with respect to the recess $11_1$ as shown in FIG. 3, so that the limit switches 14, 15 are actuated by the cam 11b as the gear 11 rotates.

The electromagnetic valve 20 is connected to the limit switches 13 to 15 so to be switched over by the actuation of the respective switches.

Figure 5:
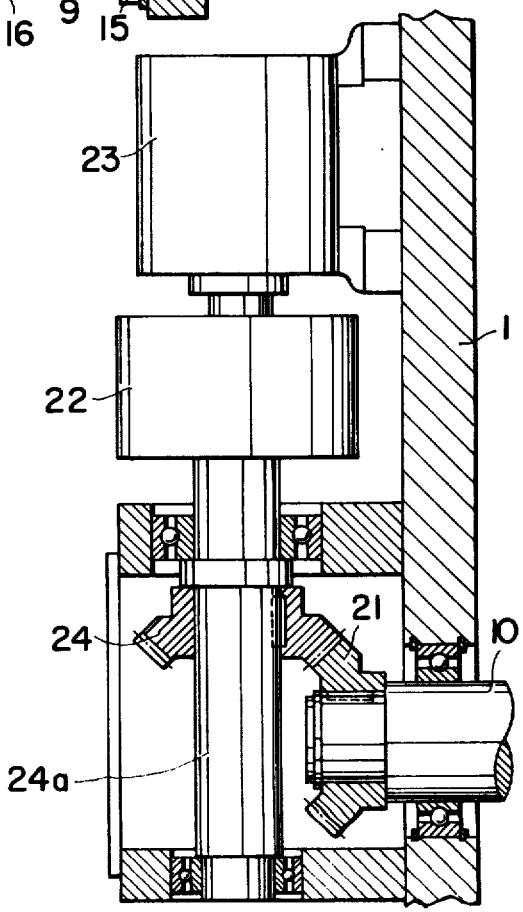
FIG. 5 is a cross-sectional view taken along line V—V in FIG. 2.

As shown in FIGS. 2 and 5, one end of the shaft 10 is provided with a bevel gear 21 secured thereto and the bevel gear 21 meshes with a bevel gear 24 secured to a shaft 24a journaled in the main body 1. The shaft 24a is driven by a separate driving means such as an electric motor 23 through an electromagnetic clutch 22 which is also connected to the limit switches 13 to 15 so as to be actuated thereby.

With the above described construction of the present invention, in case that the lateral distance between the transfer bars 4, 5 is to be adjusted depending upon the work pieces to be transferred thereby, for example, from the distance $L_1$ (FIG. 1) corresponding to the position of the driven gear 11 with respect to the limit switch 13 wherein the cam 11b is opposed to the limit switch 13 to the distance $L_2$ corresponding to the position in which the driven gear 11 is rotated by the angle $\alpha$ in the anticlockwise direction in FIG. 3 where the limit switch 14 is actuated by the cam 11b, the electromagnetic valve 20 is first operated by manually switching on a main switch (not shown) so as to move away the driving gear 12 by the actuation of the hydraulic cylinder 19 from the driven gear 11 to disengage the clutch means 9. Then, the shaft 24a is driven by the electric motor 23 through the electromagnetic clutch 22 when one of slide distance adjusting switches corresponding to a desired distance between the transfer bars 4, 5 is manually switched on. Thus, the shaft 10 and the gear 11 are driven through the bevel gears 21, 24 independently of the driving gear 12 so that the pinion 8 and the shaft 10 are rotated thereby moving the slides 2, 3 in the directions opposite to each other to open the distance between the transfer bars 4, 5.

When the distance between the slides 2, 3 and, hence, the transfer bars 4, 5 reaches the distance $L_2$ by switching on a slide distance adjusting switch for the distance $L_2$, the limit switch 14 is actuated by the cam 11b by the rotation of the gear 11 so that the electromagnetic valve 20 is switched over to move the driving gear 12 toward the gear 11 by the actuation of the hydraulic cylinder 19 so as to engage the clutch means 9 and, at the same time, the electromagnetic clutch 22 is disengaged thereby stopping the rotation of the shaft 24a. On the other hand, by the engagement of the clutch 9, the pinion 8 engaged with the gear 11 are alternately rotated through the gear 12 in both directions opposite to each other by the reciprocal action of the rack 16 moved by the drive system 17 having synchronized relation to the operation of the press for the purpose of gripping and releasing operations of the workpieces. Thus, the device is ready for the operation of the press in which the distance between the transfer bars 4, 5 is adjusted to $L_2$.

In the similar way, the distance between the transfer bars 4, 5 is adjusted from $L_1$ or $L_2$ to $L_3$ corresponding to the position of the cam 11b of the gear 11 being moved to oppose against the limit switch 15 in FIG. 3.

On the other hand, the case that the lateral distance between the transfer bars 4, 5 is adjusted to far apart, for example, to move the bars from the distance $L_2$ to the distance $L_1$, a slide distance adjusting switch for the distance $L_1$ is manually switched on after switching on the main switch. As a result, the electric motor is rotated in the reverse direction and, at the same time, the electromagnetic clutch 22 is also engaged. Thus, the slides 2, 3 and, hence, the transfer bars 4, 5 are approached to each other to close the lateral distance therebetween. When the lateral distance between the transfer bars 4, 5 reaches the distance $L_1$, the limit switch 13 is actuated by the cam 11b so that the electromagnetic valve 20 is switched over to move the driving gear 12 toward the gear 11 so as to engage the clutch means 9, at the same time, the electromagnetic clutch 22 is disengaged, thereby stopping the movement of the slides 2, 3 by the operation of the electric motor. Other adjustments of the lateral distance between the transfer bars 4, 5 from $L_3$ to $L_1$ and from $L_3$ to $L_2$ are carried out by the similar manner.

The distance $L_2$, $L_3$ may be changed by adjusting the angular positions of the limit switches 14, 15 together with the corresponding change in location of the engaging recesses $11_2$, $11_3$, $11_5$, $11_6$.

Further, the cam 11b may be changed to a magnetic piece when the limit switches are changed to magnetically actuated switches such as reed switches.

With the present invention, the adjustment of the distance between the transfer bars can be made very simple and efficient without requiring troublesome and time consuming manual operation by the operator while the high accuracy in the adjustment is maintained.

I claim:

1. A device for adjusting the lateral distance between a pair of parallel transfer bars of a transfer feeder for a transfer press comprising:

a. a pair of slides, said transfer bars being mounted on said slide, said pair of slides being a predetermined distance apart;

b. first drive means for driving said transfer bars toward and away from each other in a reciprocating motion in synchronism with the operation of said press for successively transferring work pieces to succeeding work positions;

c. second drive means for resetting said predetermined distance;

d. coupling means connected to said pair of slides; and e. first engaging means for engaging and disengaging said first drive means and said coupling means from each other wherein said first drive means and said coupling means are engaged for reciprocating said transfer bars and said first drive means and said coupling means are disengaged from each other when said second drive means resets said predetermined distance.

2. The device of claim 1 wherein said coupling means comprises:

a. a first driven gear;

b. a shaft;

c. first and second pinions mounted on said shaft, one of said pinions engaging said first driven gear;

d. first and second racks, each of said racks being coupled to one of said pinions and to one of said transfer bars.

3. The device of claim 2 wherein said first engaging means comprises a clutch mechanism for coupling said first driving means to said first driven gear.

4. The device of claim 3 wherein said first drive means includes a second driven gear and means for driving said gear wherein said clutch mechanism engages said first and second driven gears.

5. The device of claim 4 wherein said first driven gear includes a plurality of grooves and said second driven gear includes a plurality of jaws for engaging said grooves when said first and second driven gears are engaged by said clutch mechanism.

6. The device of claim 2 wherein said second driving means comprises:

a. a cam mounted on said first driven gear;

b. a plurality of switch means positioned around said first driven gear, said switch means being actuable upon alignment with said cam;

c. a motor means; and d. electromagnetic clutch means for operatively connecting said first driven gear to said motor means whereby said motor means rotates said first gear means to reset said predetermined position.

7. The device of claim 6 wherein said first driven gear is operatively connected to said motor by a shaft coupled to said first driven gear and aligned with the axis thereof and means coupling said shaft to said electromagnetic clutch means.

* * * * *